United States Patent [19]

Burgio di Aragona

[11] Patent Number: 4,505,187

[45] Date of Patent: Mar. 19, 1985

[54] RECIPROCATING PISTON ENGINE WITH SWASH PLATE MECHANISM

[75] Inventor: Antonio Burgio di Aragona, Moncalieri, Italy

[73] Assignee: Fiat Auto S.p.A., Turin, Italy

[21] Appl. No.: 365,927

[22] Filed: Apr. 5, 1982

[30] Foreign Application Priority Data

Jan. 13, 1982 [IT] Italy ..... 67031 A/82

[51] Int. Cl.[3] ..... F01B 3/02; F01B 31/10

[52] U.S. Cl. ..... 92/31; 92/71; 92/153; 91/501; 91/502; 417/269

[58] Field of Search ..... 74/60; 417/269; 123/58 R; 91/501, 502; 92/12.1, 12.2, 31, 68, 71, 33, 76, 153, 157; 384/291, 292, 317

[56] References Cited

U.S. PATENT DOCUMENTS

| | | | |
|---|---|---|---|
| 927,297 | 7/1909 | Tuckfield | 92/71 |
| 1,898,659 | 2/1933 | Gardner | 384/292 |
| 2,077,986 | 4/1937 | Cassani | 74/60 |
| 2,362,158 | 11/1944 | Ricardo | 92/157 |
| 3,304,885 | 2/1967 | Orth | 92/153 |

FOREIGN PATENT DOCUMENTS

| | | | |
|---|---|---|---|
| 55-114888 | 4/1980 | Japan | 91/502 |
| 128925 | 7/1920 | United Kingdom | 91/502 |

*Primary Examiner*—Robert E. Garrett
*Assistant Examiner*—Scott L. Moritz
*Attorney, Agent, or Firm*—Sughrue, Mion, Zinn, Macpeak and Seas

[57] ABSTRACT

A reciprocating engine, in particular for motor vehicles, incorporating a drive shaft, at least one pair of opposed pistons rigidly connected together by a rod, and a swash plate mechanism incorporating a pair of rotating swash plates coupled for rotation with the drive shaft and defining an annular cavity in which at least one oscillating plate is rotatably housed. Coupling means pivotally connect each oscillating plate with at least one respective rod connecting a pair of pistons, and a hydrodynamic thrust bearing is interposed between each of the two rotating plates and the facing surface of the oscillating plate.

8 Claims, 7 Drawing Figures

RECIPROCATING PISTON ENGINE WITH SWASH PLATE MECHANISM

Figure 1:
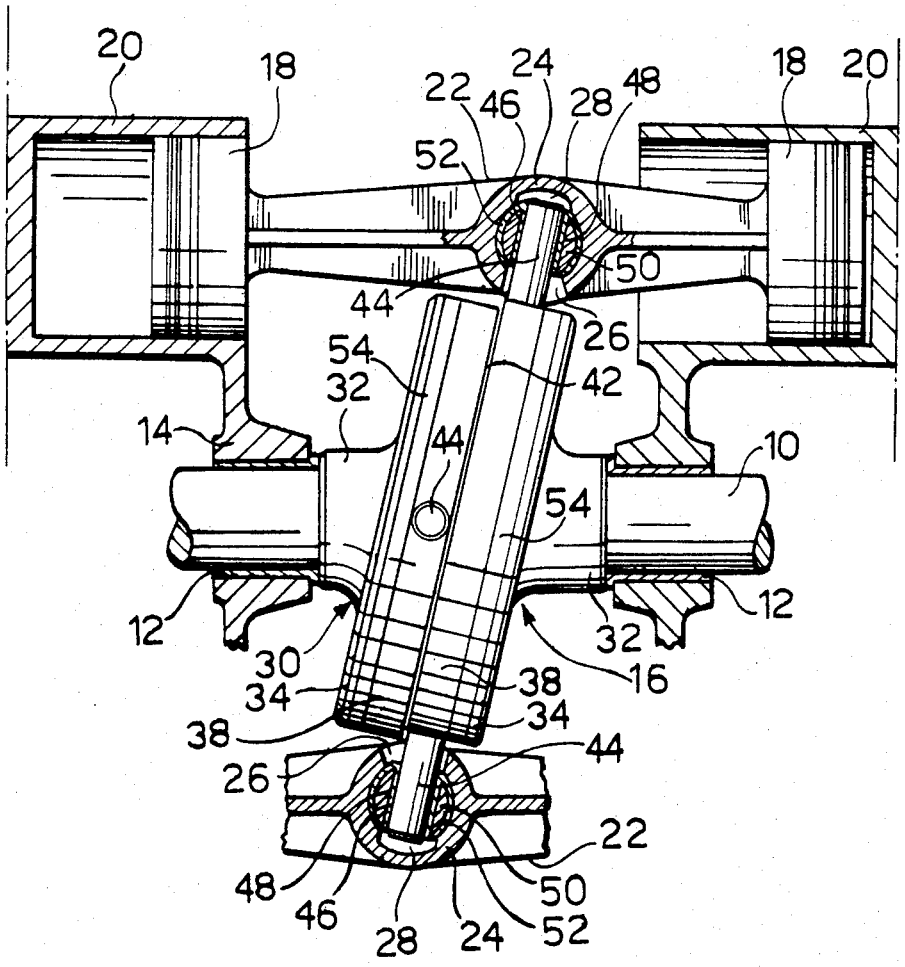

The present invention relates generally to reciprocating piston engines with swash plate mechanisms.

In particular, the invention relates to a reciprocating engine comprising a drive shaft, at least one pair of opposed pistons with their axes parallel to that of the drive shaft, and a swash plate mechanism for converting the reciprocating straightline motion of the pistons into rotary motion of the drive shaft.

The object of the present invention is to provide an engine of this type which is particularly compact, strong and highly reliable in operation and requires only a small number of components which may be simply and economically manufactured and assembled.

The invention achieves its object by virtue of the fact that a reciprocating engine of the type initially defined is characterised in that the opposed pistons of the or each pair are rigidly connected together by a rod, and in that the swash plate mechanism comprises:

a rotating containing structure which includes a pair of mutually-facing rotating swash plates, this rotating containing structure being coupled for rotation with the drive shaft and defining an annular cavity which is bounded by the two rotating plates and has its bottom inclined relative to the drive shaft, at least one oscillating plate housed in the said annular cavity and mounted for rotation relative to the bottom of the said cavity, coupling means for pivotally connecting the or each oscillating plate with at least one respective rod connecting a pair of pistons, and a hydrodynamic thrust bearing interposed between each of the two rotating plates and the facing surface of the oscillating plate, for the purpose of bearing the thrust transmitted to the or each oscillating plate by the or each pair of pistons through the said pivotal coupling means.

According to a preferred embodiment of the invention, each hydrodynamic thrust bearing comprises a thrust block rigid with the corresponding rotating plate and provided with a spiral channel which is formed in the surface of the block facing towards the oscillating plate and which spirals outwards in a direction counter to that in which the drive shaft rotates, and means for feeding a liquid lubricant to the said spiral channel, in correspondence with the inmost turn of this channel.

According to one variant of the invention, each hydrodynamic thrust bearing comprises a circumferential series of radial sliding blocks or segments, each of which orientably rests against the oscillating plate, and means for feeding liquid lubricant between the sliding blocks of the series and the corresponding rotating plate in the region of the radially inner ends of these sliding blocks.

Alternatively, each of the radial sliding blocks of the circumferential series orientably rests against the corresponding rotating plate, and means are provided for feeding liquid lubricant between the sliding blocks of the series and the oscillating plate, in the region of the radially inner ends of the sliding blocks.

Figure 2:
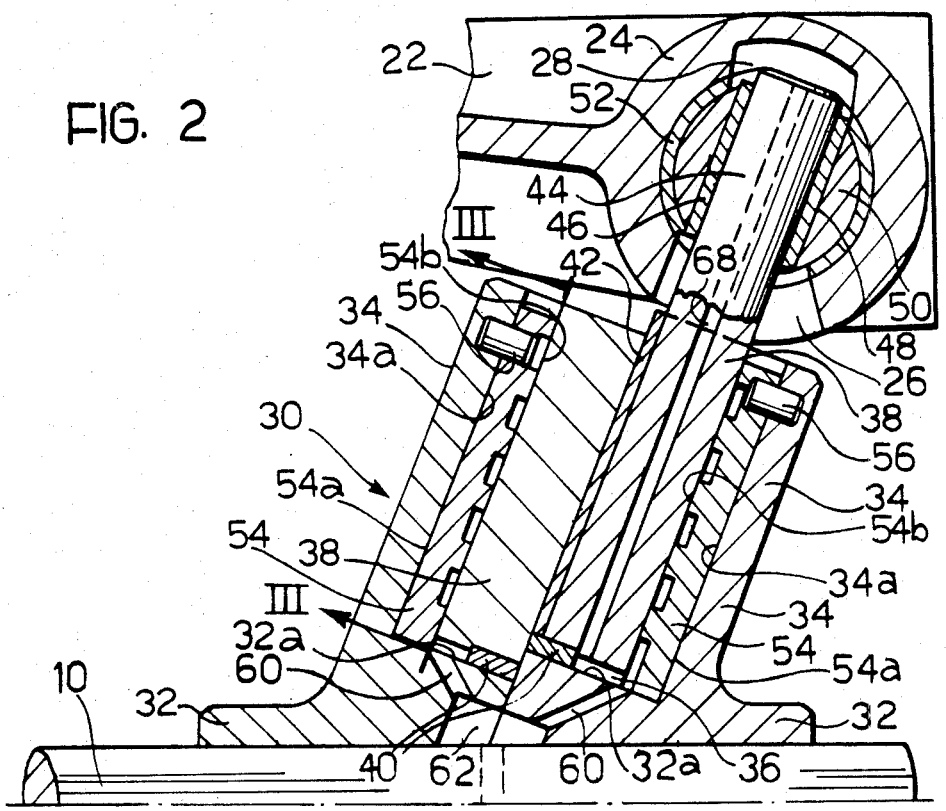
Figure 3:
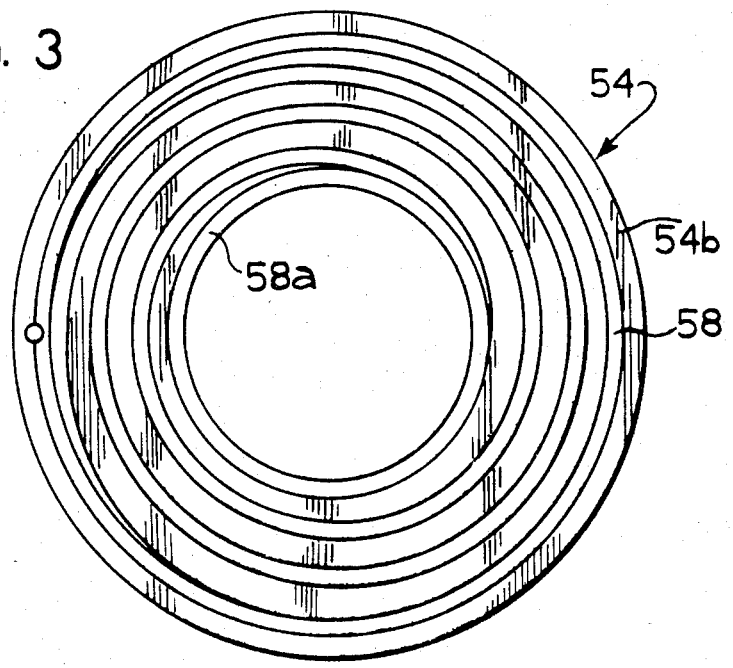
Figure 4:
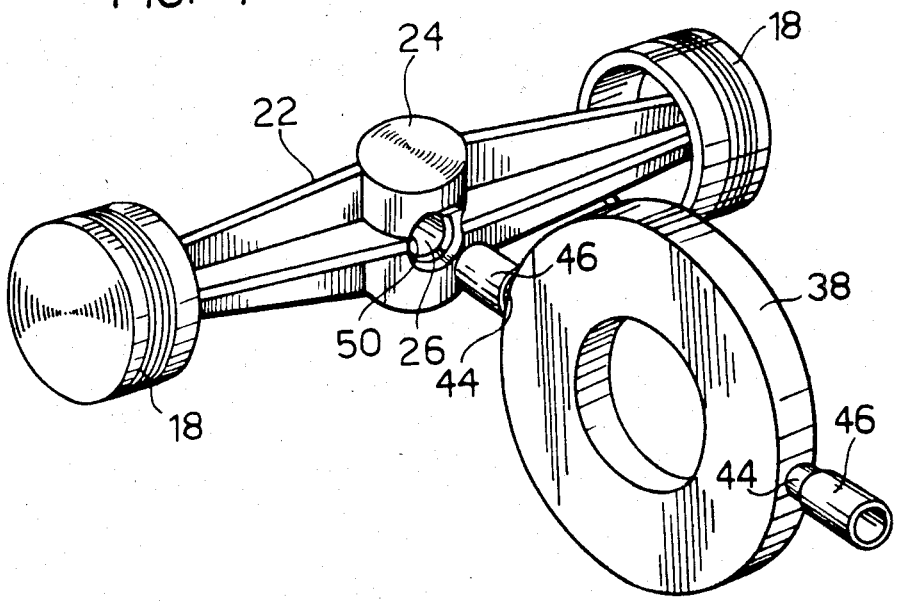
Figure 7:
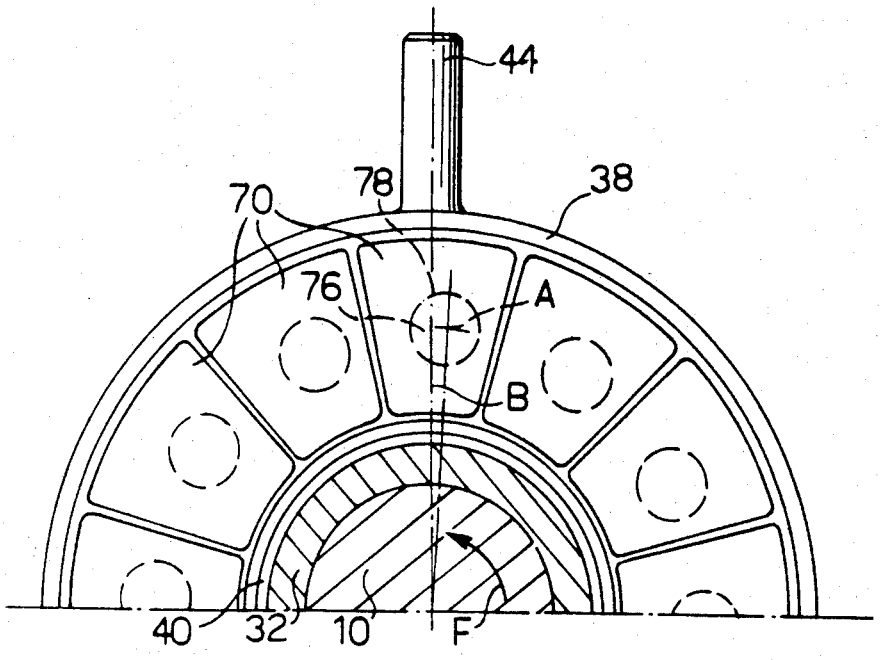
Figure 5:
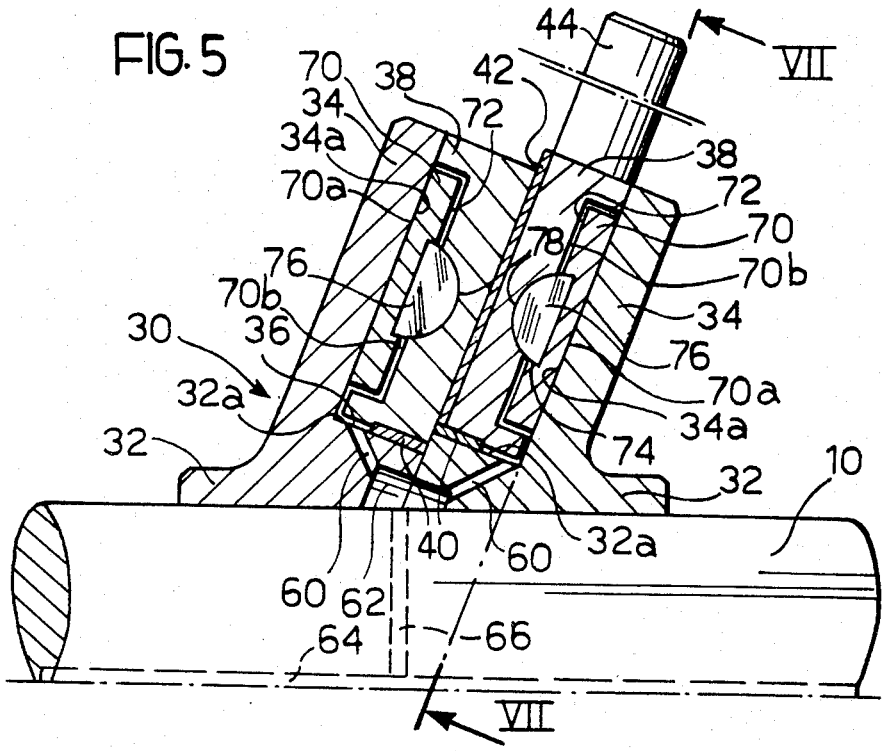
Figure 6:
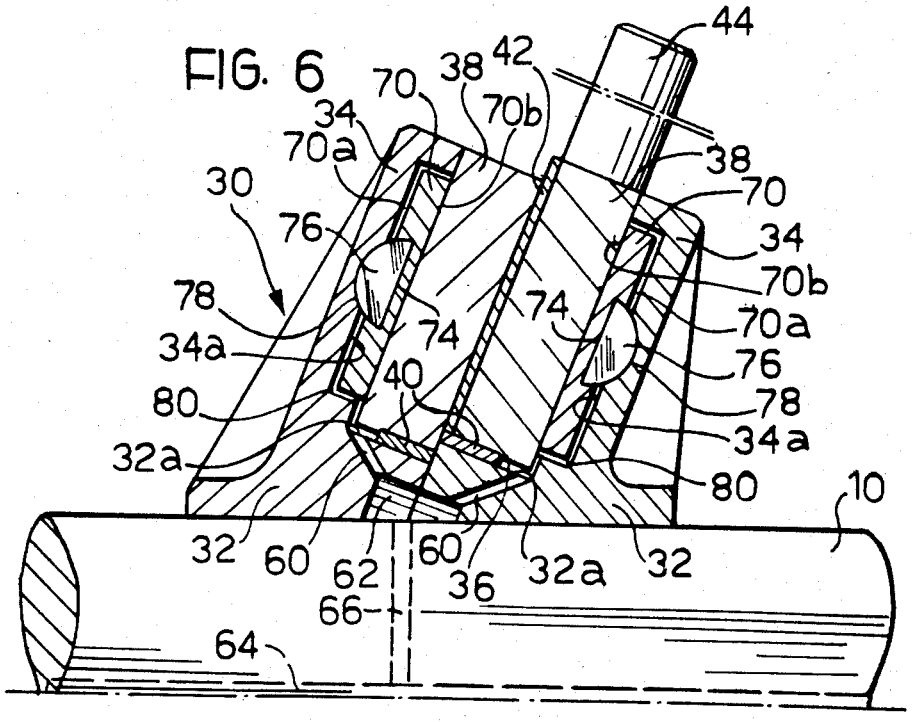

The invention will now be described in detail with reference to the appended drawings, supplied purely by way of non-limiting example, and in which:

FIG. 1 is a partially sectional and partially cut-away diagrammatic view of part of a reciprocating engine according to the invention, FIG. 2 is a sectional view to an enlarged scale of part of FIG. 1 according to a preferred embodiment of the invention, FIG. 3 is a sectional view to an enlarged scale taken along the line III—III of FIG. 2, FIG. 4 is an exploded perspective view of a detail of FIGS. 1 and 2, FIG. 5 shows a first variant of FIG. 2, FIG. 6 shows a second variant of FIG. 2, FIG. 7 is a sectional view taken along the line VII—VII of FIG. 5.

The following description, which relates to the example shown in the drawings, refers to an eight cylinder internal combustion engine for use in motor vehicles.

Referring initially to FIG. 1, by 10 is shown a drive shaft rotatably mounted by sliding bearings 12 in a structure serving as a crankcase, part of which is shown diagrammatically at 14. Keyed onto the central part of the shaft 10 is a swash plate, shown in its entirety by 16, which will be described in detail later.

By 18 are shown two opposed pistons which have their axis parallel to that of the drive shaft 10 and are each slidingly mounted in a respective cylinder shown diagrammatically by 20. Associated with each cylinder 20 are means, known per se, and not illustrated, for forming a combustible mixture for effecting controlled ignition of this mixture, and for discharging combustion gases.

As stated above, the engine shown in the example is of the eight cylinder type. In fact, in addition to the pair of pistons 18 shown in FIG. 1, the engine comprises a second pair of identical opposed pistons, not illustrated, arranged on the opposite side of the drive shaft 10 with their axes in a plane containing the axis of the illustrated pair of pistons 18, and a third and a fourth pair of idential pistons, also not visible in the drawings, arranged on opposite sides of the drive shaft 10 with their axes parallel to the axis of this shaft 10 and contained in a common plane which intersects at right angles, along the axis of shaft 10, the plane containing the axes of the other two pairs of pistons.

The description of the unit which includes the two illustrated pistons 18 is equally applicable to the other three units of pairs of pistons which are not illustrated.

The two pistons 18 are rigidly connected together by means of a rod of cross-shaped transverse section 22 the central part of which is shaped as a cylindrical bush 24 with its axis directed transversely to the axis of the two pistons 18. As may be also clearly seen in FIG. 4, the bush 24 laterally presents, on that part thereof which faces towards the drive shaft 10, an opening 26, and on its part which is diametrally opposed to the latter, an internal recess 28. The angular widths of the opening 26 and the recess 28 are predetermined in a manner which will be explained later.

The swash plate mechanism 16 comprises a containing structure 30 formed by two opposed portions each of which includes a hub part 32 coupled for rotation, for example, by means of a simple force-fit, with the drive shaft 10, and an outer disc-shaped plate 34 formed in a single piece with the hub 32 and surrounding it in correspondence with the middle zone of the latter. The two disc-shaped plates 34, which will be hereinafter referred to as 'rotating plates', are parallel to each other and inclined relative to the axis of the drive shaft 10. The internal face 34*a* of the rotating plates 34 are completely flat and define an outwardly open annular cavity 36, the internal end wall of which is defined by the lateral surfaces 32*a* of the ends of the two hub parts 32 which face each other and are in mutual frontal contact. The surfaces 32*a* are cylindrical surfaces which extend perpendicularly to the internal faces 34*a* of the rotating plates 34, and are therefore inclined relative to the axis of the drive shaft 10, and which have their respective axes slightly staggered relative to one another.

Two disc-shaped plates 38, which will be hereinafter referred to as 'oscillating plates', are rotatably housed in the annular cavity 36, with their respective axes parallel and staggered to one another.

Each of the oscillating plates 38 is rotatably supported on one of the surfaces 32*a* by means of a sliding bearing 40 with an axial length less than the thickness of the corresponding oscillating plate 38. The bearings 40 are both offset towards the center point of the containing structure 30, that is, towards the mutually facing surfaces of the oscillating plates 38 between which an annular element of antifriction material 42 is interposed. This annular element 42 may be omitted and the facing surfaces of the two oscillating plates 38 subject to a lubrication treatment prior to assembly, using substances such as molibdenum disulphide, for example.

As illustrated in detail in FIGS. 1 and 4, each of the oscillating plates 38 incorporates a pair of peripheral radial bolts 44, diametrally opposed to each other, which project out of the containing structure 16. The bolts 44 of one of the plates 38 are used to connect it pivotally to the rods 22 of the two pairs of pistons 18 whose axes are contained in a first common plane, whilst the bolts 44 of the other plate 38 are staggered by 90° and serve to pivotally connect the said other plate 38 to the rods 22 of the other two pairs of pistons 18 whose axes are contained in a second common plane.

Each of the radial bolts 44 passes through the opening 26 of a respective bush 24 and slidingly and rotatably engages a sleeve 46 of antifriction material inserted in a diametral hole 48 of a cylindrical pin 50 which in its turn is rotatably housed, with the interposition of a second sleeve 52 of antifriction material, in the cavity of the bush 24. As a result, each of the bolts 44 can execute, relative to its corresponding bush 24, a translational movement along its own axis and rotational movement both around its own axis and around the axis of the bush itself. The depth of the recesses 28 and the angular width of these recesses and of the openings 26 must obviously be such as to permit the full movement of the bolts 44 resulting from the receiprocation of the pistons 18 during running of the engine.

Still referring to FIG. 1, according to the invention a hydrodynamic thrust bearing is interposed between each of the rotating plates 34 of the containing structure 30 and the surface of the facing oscillating plate 38. These thrust bearings serve to bear the thrust transmitted during operation to the oscillating plates 38 from the pairs of pistons 18, through the bolts 44.

According to the preferred embodiment shown in FIGS. 2 and 3, each hydrodynamic thrust bearing comprises a thrust block 54 coupled for rotation by means of a retaining pin 56, with one of the rotating plates 34. The thrust block 54 has a flat external face 54*a* in contact with the internal surface 34*a* of the rotating plate 34, and an internal face 54*b* facing the oscillating plate 38 and in which a spiral channel 58 is formed. This spiral channel 58, which in the example shown is shaped as an Archimedes' spiral, winds from the radially inner zone of the thrust block 54 in a direction counter to that in which the drive shaft 10 rotates. Assuming that the shaft 10 rotates in a clockwise direction, the spiral channel 58 therefore winds in an anticlockwise direction.

The inmost turn 58*a* of the channel 58 of each thrust block 54 is situated in correspondence with the inner circumferential edge of the block and communicates with the annular cavity 36 of the containing structure 30 in a respective zone defined between one of the surfaces 32*a*, the internal circumferential surface of the corresponding oscillating plate 38, and the associated sliding bearing 40. Each of these zones is connected, by means of one or more oblique passages 60 formed in the hub parts 38, to one or more recesses 62 formed in the inner circumferential surface of the containing structure 30 and facing the external surface of the drive shaft 10. The recesses 62, which are preferably diametrally opposed each other in pairs, are in their turn connected via respective radial passages 66 to an axial passage 64 to enable a liquid lubricant to be fed to the spiral channels 58 of the thrust blocks 54. The same liquid lubricant is also fed, through radial passages 68 formed in the oscillating plates 38 and extending through the bolts 44, into the cavity of the bush 24 to enable lubrication of the pivotal couplings between the oscillating plates 38 and the rods 22.

During operation of the above-described engine, the reciprocating straightline displacement of the four pairs of pistons 18 is converted, through the oscillating plates 38, into rotary motion of the containing structure 30 and the drive shaft 10 rigid with this structure 30. The liquid lubricant fed to the spiral channels 58 of the two thrust blocks 54 forms an elongate pressurised bed capable of effectively bearing the pulsating loads imparted by the pistons 18 to the oscillating plates 38. The special shape and arrangement of the channels 58 enables the pressure, and hence the load-bearing ability of the elongate bed, advantageously to increase by centrifugal effect as the engine revolutions increase. The liquid lubricant, after it has passed completely through the spiral channels 58, exits from the peripheral turns of the latter to the outside of the containing structure 30, to be collected in a sump (not illustrated) situated in the lower part of the engine from where it is circulated back to the axial passage 64 of the drive shaft 10.

FIGS. 5 and 6 show two variants of FIG. 2 and relate in particular to two different embodiments of the hydrodynamic thrust bearings interposed between the rotating plates 34 and the oscillating plates 38. In these Figures parts identical or similar to those illustrated in FIG. 2 are shown with the same reference numerals and only the differences will be described in detail.

According to the variant of FIG. 5, each of the hydrodynamic thrust bearings is formed by a circumferential series of orientable radial sliding blocks or segments 70, which are each generally shaped as an isosceles trapezoid with a rounded base. The sliding blocks 70 of each series are located within an annular recess 72 of a respective oscillating plate 38 and have flat external faces 70*a* facing the internal surface 34*a* of the corresponding rotating plate 34. A substantially cylindrical recess 74 is formed in the internal face 70*b* of each sliding block 70, that is, the face which faces towards the bottom of the annular recess 72. A semi-spherical bearing element 76 is engaged in the recess 74, the convex surface of the element 76 being located in a rebate of complementary shape 78 formed in the bottom of the annular recess 72. As illustrated in detail in FIG. 7, the axis A of the recess 74 of each sliding block 70 is offset to the rear of the block centreline B with respect to the direction of drive shaft 10 rotation which is indicated by F in the same Figure.

The liquid lubricant fed during operation into the bottom of the annular chamber 36 through the passages 64 and 66, the chamber or chambers 62 and the passages 60, causes the formation of a lubricating film under pressure between the facing surfaces 34*a* and 70*a* respectively of the rotating plates 34 and the sliding blocks 70 of each series. This film under pressure is capable of effectively bearing the thrust conveyed to the two oscillating plates 38 from the pairs of pistons 18.

The variant shown in FIG. 6 differs from the embodiment in FIG. 5 only in that the sliding blocks 70 of both series are orientably supported by the two rotating plates 34 instead of by the oscillating plates 38. In fact, in this instance the two series of sliding blocks 70 are housed in respective annular recesses 80 formed in the internal surfaces 34*a* of the two rotating plates 34, and the recesses 78 and 74 for the semispherical bearing elements 76 are formed in the bottom of the annular recesses 80 and on the external faces 70*a* of the sliding blocks 70 respectively. According to this variant, the lubricating film is produced during operation between the internal faces 70*b* of the sliding blocks 70 and those surfaces of the two oscillating plates 38 which face the blocks.

Although the invention is illustrated and described with reference to an eight cylinder engine, it can obviously also be applied to engines having a different number of cylinders, by simply modifying the shape of the mechanism 16 and, more particularly, by varying the number of the oscillating plates 38 in dependence on the number of cylinders. Thus, if an engine has four cylinders opposed in pairs on opposite sides of the drive shaft 10, the mechanism 16 will incorporate a single oscillating plate 38 located in the cavity 36 between the two hydrodynamic thrust bearings. On the other hand, when an engine has more than eight cylinders, the mechanism 16 will have a number of oscillating plates 38 equal to that of the cylinder groups, each incorporating two pairs of opposed cylinders with their axes contained in a respective common plane.

Naturally, with the principle of the invention remaining the same, the details of construction and the embodiments may be widely varied relative to that which has been described and illustrated, without thereby departing from the scope of the present invention.

I claim:

1. In a reciprocating engine incorporating a drive shaft, at least one pair of opposed pistons with their axes parallel to that of the drive shaft, and a swash plate mechanism for converting the reciprocating straightline motion of the pistons into rotary motion of the drive shaft, the improvement wherein a respective rod rigidly interconnects the opposed pistons of the or each said pair of pistons, and said swash plate mechanism comprises:

a rotating containing structure which includes a pair of mutually-facing rotating swash plates, said rotating containing structure being coupled for rotation with said drive shaft and defining an annular cavity which is bounded by the two said rotating plates and has a bottom inclined relative to said drive shaft, at least one oscillating plate housed in said annular cavity and mounted for rotation relative to said bottom of said cavity, coupling means for pivotally connecting said at least one oscillating plate with at least one respective said rod connecting a said pair of pistons, and a hydrodynamic thrust bearing interposed between each of the two said rotating plates and the corresponding facing surface of said at least one oscillating plate for the purpose of bearing the thrust conveyed to said at least one oscillating plate from the pistons through said pivotal coupling means, wherein, each said hydrodynamic thrust bearing incorporates a thrust block which is rigid with the corresponding said rotating plate and is formed to define a spiral channel in the surface of said block that faces towards said at least one oscillating plate, said channel spiralling outwardly in a direction counter to that in which said drive shaft is intended to rotate, each thrust bearing further including means for feeding liquid lubricant to said spiral channel of the bearing, in correspondence with the inmost turn of said channel with said spiral channel terminating in an outer annular channel to define a pressurized bed for bearing the pulsating loads imparted by said pistons to said plates.

2. An engine according to claim 1, wherein the said containing structure has a hub part which is connected to said drive shaft and defines the said bottom of the said annular cavity, said hub part being formed both with at least one recess facing the surface of the drive shaft and with lubricating passages communicating said at least one recess with said annular cavity on opposite sides of said at least one oscillating plate, the said drive shaft being formed with an axial passage and with at least one radial passage which communicates said axial passage with the said at least one recess in the hub part whereby to allow lubricant to flow therebetween.

3. An engine according to claim 2, wherein a sliding bearing is interposed between the said hub part of the containing structure and the or each of said oscillating plates, said sliding bearing having an axial length which is less than the thickness of the or of the corresponding oscillating plate.

4. An engine according to claim 1, wherein the rod which interconnects the or each pair of opposed pistons carries at its centre a rotatable transverse pin formed with a diametral hole, the or the corresponding said oscillating plate incorporating a corresponding peripheral radial bolt which projects from the said containing structure and is slidingly and rotatably engaged in said diametral hole of the said rotatable pin.

5. An engine according to claim 4, wherein said rod is centrally formed with a bush and is provided with a first sleeve of antifriction material housed in said bush, said pin being coaxially rotatable within said first sleeve and being provided with a second sleeve of antifriction material located in its said diametral hole of the pin, the said radial bolt of the oscillating plate being slidable and rotatable within said second sleeve; said bush in the zone through which the said bolt passes being formed with an opening of a width that corresponds substantially to the width of the operative angular displacement of the bolt relative to the bush and, in the zone diametrally opposed to this opening, with an internal recess of corresponding width.

6. An engine according to claim 5, wherein the said containing structure has a hub part which is connected to said drive shaft and defines the said bottom of the said annular cavity, said hub part being formed both with at least one recess facing the surface of the drive shaft and with lubricating passages communicating said at least one recess with said annular cavity on opposite sides of said at least one oscillating plate, the said drive shaft being formed with an axial passage and with at least one radial passage which communicates said axial passage with the said at least one recess in the hub part whereby to allow lubricant to flow therebetween, the said at least one oscillating plate being formed with a lubricating passage which extends from the said recess in the hub part of the containing structure, through the plate and its said radial bolt, to outlet within said bush formed in the rod which interconnects the or a corresponding said pair of pistons.

7. An engine according to claim 1, wherein four pairs of opposed pistons are provided with the axes of two said pairs being contained in a first common plane and the axes of the other two said pairs being contained in a second common plane which intersects the said first common plane along the axis of said drive shaft, the engine comprising two adjacent said oscillating plates each provided with a pair of radial peripheral bolts which are diametrally opposed and project from the said containing structure for pivotal connection to the said rods which interconnect the pistons of the two corresponding said pairs of pistons, each said oscillating plate being rotatable relative to the other.

8. An engine according to claim 7, further comprising antifriction means interposed between the said two oscillating plates.

* * * * *